US008482371B2

(12) United States Patent
Jeong et al.

(10) Patent No.: US 8,482,371 B2
(45) Date of Patent: Jul. 9, 2013

(54) CHIP-TYPE COIL COMPONENT

(75) Inventors: Dong Jin Jeong, Busan (KR); Jae Wook Lee, Gyeongsangnam-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 13/331,673

(22) Filed: Dec. 20, 2011

(65) Prior Publication Data

US 2012/0274432 A1 Nov. 1, 2012

(30) Foreign Application Priority Data

Apr. 29, 2011 (KR) ..... 10-2011-0040829

(51) Int. Cl.
*H01F 5/00* (2006.01)
*H01F 27/29* (2006.01)
*H01F 27/28* (2006.01)

(52) U.S. Cl.
USPC ..... 336/200; 336/192; 336/232

(58) Field of Classification Search
USPC ..... 336/192, 200, 232
See application file for complete search history.

(56) References Cited

U.S. PATENT DOCUMENTS

| | | | | |
|---|---|---|---|---|
| 6,388,550 | B1 * | 5/2002 | Kanetaka et al. | 336/223 |
| 7,378,930 | B2 * | 5/2008 | Inuzuka | 336/200 |
| 2010/0225437 | A1 * | 9/2010 | Ueda et al. | 336/200 |
| 2010/0271163 | A1 * | 10/2010 | Nakamura et al. | 336/200 |

FOREIGN PATENT DOCUMENTS

| | | | |
|---|---|---|---|
| JP | 61-8574 | | 3/1986 |
| JP | 07-057935 | | 3/1995 |
| JP | 07-320939 | A | 12/1995 |
| JP | 07320939 | A * | 12/1995 |
| JP | 08-130118 | | 5/1996 |
| JP | 11-265823 | | 9/1999 |
| JP | 2002-198229 | A | 7/2002 |

OTHER PUBLICATIONS

Office Action with English translation issued on Apr. 30, 2012 in the corresponding Korean Patent Application No. 10-2011-0040829.
Japanese Office Action, and English translation thereof, issued in Japanese Patent Application No. 2011-274221 dated May 7, 2013.

* cited by examiner

*Primary Examiner* — Mohamad Musleh
*Assistant Examiner* — Tsz Chan
(74) *Attorney, Agent, or Firm* — McDermott Will & Emery LLP

(57) ABSTRACT

The chip-type coil component includes: a body; conductive patterns connected to each other so as to have a coil structure; and external electrodes formed on the bottom surface and the two surfaces in the length direction; wherein a height of the external electrodes in a thickness direction of the body is greater than a height from the bottom surface to a farthest conductive pattern therefrom among the conductive patterns and is less than a height from the bottom surface of the body to the top surface thereof. According to embodiments of the present invention, even in a case in which a chip-type coil component set contacts a metal can, interference such as short-circuits does not occur, and as a result, a chip-type coil component having excellent reliability can be acquired.

11 Claims, 2 Drawing Sheets

CHIP-TYPE COIL COMPONENT

CROSS-REFERENCE TO RELATED APPLICATIONS

This application claims the priority of Korean Patent Application No. 10-2011-0040829 filed on Apr. 29, 2011, in the Korean Intellectual Property Office, the disclosure of which is incorporated herein by reference.

BACKGROUND OF THE INVENTION

1. Field of the Invention

The present invention relates to a chip-type coil component, and more particularly, to a chip-type coil component having excellent reliability.

2. Description of the Related Art

Along with the miniaturization, slimming, and multi-functionalization of electronic products, chip components thereof are also required to be miniaturized, and the mountings of electronic components have also become high-integrated. A space between the electronic components mounted in accordance with this tendency is therefore minimized.

Further, a metal can may be disposed to cover an electronic component set mounted in order to suppress inter-noise interference between electronic components in the electronic component set. The metal can may be installed so as to minimize a spacing distance thereof from electronic components contained therein, according to a high-integration tendency.

In an internal coil structure of a general multilayer inductor, an in/out lead may exist in upper and lower parts of an inductor body and external electrodes may be applied to the entirety of end surfaces and parts of surfaces adjacent to the end surfaces of the body, in order to electrically connect the in/out lead, and a plating layer may be formed thereon. As a result, the external electrodes are formed on six external surfaces of the inductor body.

As described above, in the case of a general multilayer electronic component, an external electrode may be formed on a top surface of a ceramic body of an electronic component. In this case, the external electrode formed on the top surface of the ceramic body may contact the metal can, and as a result, a short circuit may occur, causing the electronic component set to malfunction.

Accordingly, an external electrode shape needs to be improved in order to allow for the normal implementation of electrical characteristics of the electronic component set and maintain chip strength at the time of surface mounting thereof, while maintaining the same internal structure as an existing multilayer electronic component.

SUMMARY OF THE INVENTION

An aspect of the present invention provides a chip-type coil component having excellent reliability.

According to an aspect of the present invention, there is provided a chip-type coil component, including: a body formed by stacking a plurality of magnetic layers and including a bottom surface provided as a mounting surface, a top surface opposed thereto, two surfaces in a length direction thereof and two surfaces in a width direction thereof; conductive patterns formed on magnetic layers and connected to each other so as to have a coil structure; and external electrodes formed on the bottom surface and the two surfaces in the length direction; wherein a height of the external electrodes in a thickness direction of the body is greater than a height from the bottom surface to a farthest conductive pattern therefrom among the conductive patterns and is less than a height from the bottom surface of the body to the top surface thereof.

The external electrodes may be further formed on the two surfaces of the body in the width direction.

An insulating layer may be formed on an area of the surfaces of the body, in which the external electrodes are not formed.

An insulating layer may be formed on the entirety of the surfaces of the body and the external electrodes are formed on the insulating layer.

According to another aspect of the present invention, there is provided a chip-type coil component, including: a body formed by stacking a plurality of magnetic layers and including a bottom surface provided as a mounting surface, a top surface opposed thereto, two surfaces in a length direction thereof and two surfaces in a width direction thereof; conductive patterns formed on magnetic layers and connected to each other so as to have a coil structure; and external electrodes formed on the bottom surface and the two surfaces of the body in the length direction; wherein, a height of one external electrode formed on one surface of the body in the length direction is greater than a height from the bottom surface to a farthest conductive pattern therefrom among the conductive patterns and is less than a height from the bottom surface of the body to the top surface thereof, while a height of the other external electrode formed on the other surface of the body in the length direction is greater than a height from the bottom surface of the body to a closest conductive pattern thereto among the conductive patterns and is less than the height from the bottom surface of the body to the top surface thereof.

The external electrodes may be further formed on the two surfaces of the body in the width direction.

An insulating layer may be formed on an area of the surfaces of the body, in which the external electrodes are not formed.

An insulating layer may be formed on the entirety of the surfaces of the body and the external electrodes are formed on the insulating layer.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
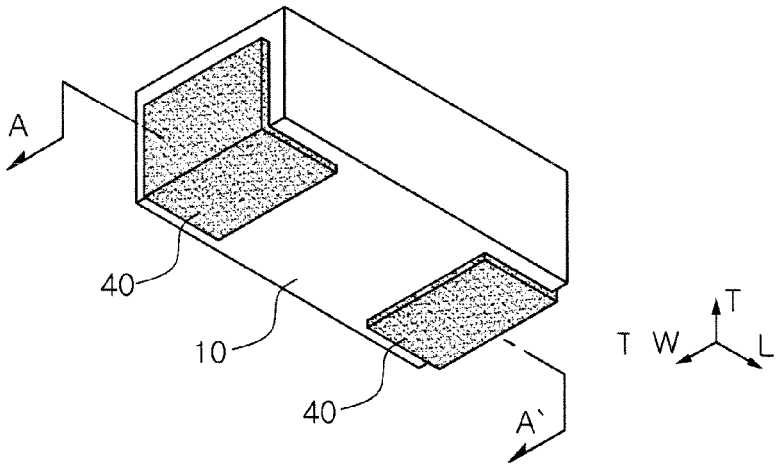
FIGS. 1 and 2 are perspective views of a chip-type coil component according to an embodiment of the present invention, when viewed from below.

Hereinafter, embodiments of the present invention will be described with reference to the accompanying drawings. However, the embodiments of the present invention may be modified in various forms and the scope of the present invention is not limited to the embodiments described below.

Embodiments of the present invention are provided so that those skilled in the art may more completely understand the present invention. Accordingly, shapes and sizes of elements in the drawings may be exaggerated for clarity of description and like reference numerals refer to like elements throughout the drawings.

Figure 2:
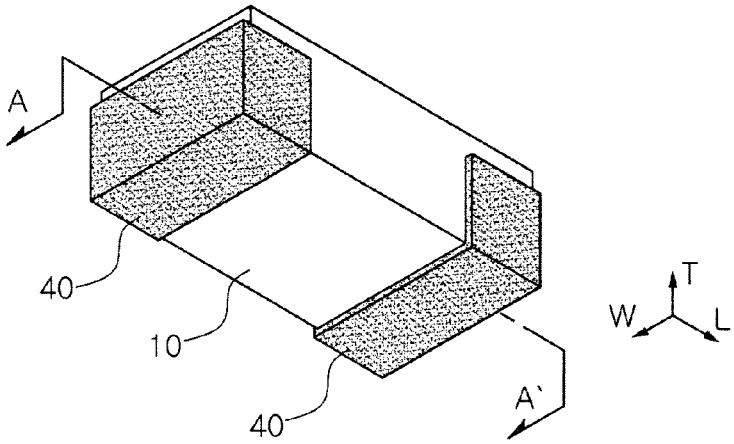
Figure 3:
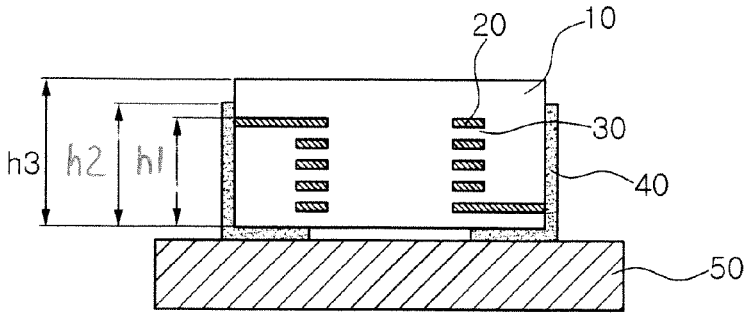
FIG. 3 is a cross-sectional view of FIGS. 1 and 2, taken along line A-A'.
Figure 4:
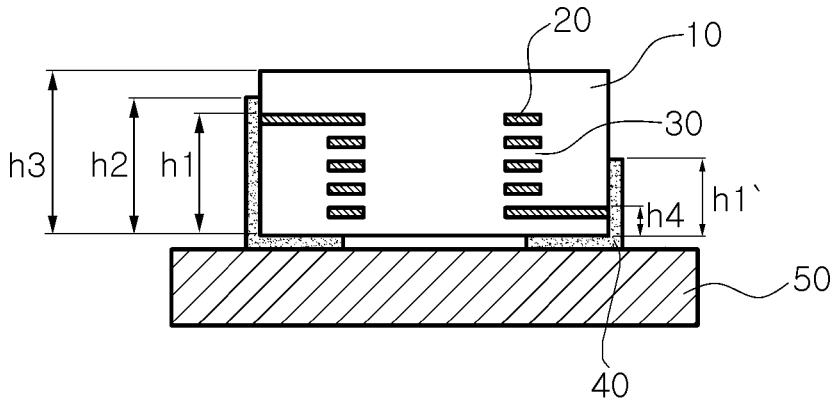
FIG. 4 is a cross-sectional view of chip-type coil component according to another embodiment of the present invention.
Figure 5:
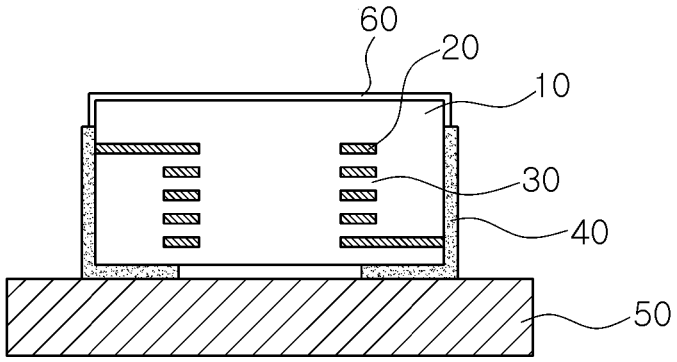
FIGS. 5 and 6 are cross-sectional views of a chip-type coil component having an additionally formed insulator according to another embodiment of the present invention.
Figure 6:
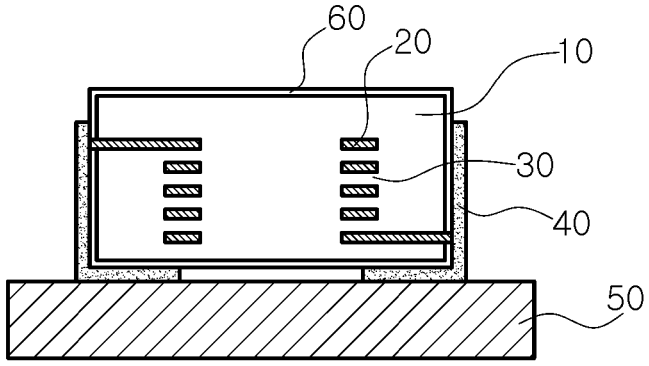

FIGS. 1 and 2 are perspective views of a chip-type coil component according to an embodiment of the present invention, when viewed from below. FIG. 3 is a cross-sectional view of FIGS. 1 and 2, taken along line A-A'. FIG. 4 is a cross-sectional view of chip-type coil component according to another embodiment of the present invention. FIGS. 5 and 6 are cross-sectional views of a chip-type coil component having an additionally formed insulator according to another embodiment of the present invention.

Referring to FIG. 1, in the chip-type coil component, a length direction L, a width direction W, and a thickness direction T are displayed as coordinates.

As shown in FIGS. 1, 2 and 3, the chip-type coil component according to the embodiment of the present invention may include a body 10 formed by stacking a plurality of magnetic layers and including a bottom surface provided as a mounting surface, a top surface opposed thereto, two surfaces in the length direction thereof and two surfaces in the width direction thereof; conductive patterns 20 formed on the magnetic layers 30 and connected to each other so as to have a coil structure; and external electrodes 40 formed on the bottom surface and the two surfaces in the length direction. In this case, a height h2 of the external electrodes in the thickness direction may be greater than a height h1 from the bottom surface to the farthest conductive pattern 20 therefrom and may be less than a height h3 from the bottom surface to the top surface. The body 10 is formed by stacking the plurality of magnetic layers and may include the bottom surface provided as amounting surface, the top surface opposed thereto, the two surfaces in the length direction and the two surfaces in the width direction.

The magnetic layers 30 may sheets manufactured by using magnetic powder. The magnetic powder is mixed into a solvent, together with a binder, and then uniformly dispersed therein through ball milling or the like. Thereafter, a thin magnetic sheet may be manufactured through a method such as a doctor blade method or the like.

The conductive patterns 20 may be formed on the magnetic layers 30 and connected to each other so as to have the coil structure.

The conductive patterns 20 may be manufactured by using a conductive paste obtained through dispersing conductive powder such as nickel powder in an organic solvent, together with the binder.

The conductive patterns 20 may be formed on the magnetic layers 30 by using a printing method such as screen printing.

The conductive patterns 20 may be connected through a via.

The via may penetrate through the magnetic layers having the conductive pattern 20 formed thereon and may be filled with a conductive metal paste.

Through the via filled with a conductive metal paste, the conductive patterns 20 disposed on top and bottom surfaces of the magnetic layers may be electrically connected to each other.

The shape of the conductive patterns 20 and the position of the via are appropriately adjusted, such that the conductive patterns 20 may have the coil structure.

As shown in FIG. 1, the external electrodes 40 may be formed on the bottom surface and the two surfaces in the length direction. That is, the external electrodes 40 may be formed on three surfaces of the body 10.

Referring to FIG. 3, the height h2 of the external electrodes in the thickness direction may be greater than the height h1 from the bottom surface to the farthest conductive pattern 20 therefrom and may be less than the height h3 from the bottom surface to the top surface. That is, the external electrodes 40 may not be formed on the top surface of the body 10.

Accordingly, in the case of the high integration of an electronic component in accordance with the miniaturization of an electronic product, defects such as the short-circuits or malfunction of the electronic product caused by contact between the external electrodes formed on the top surface of the body 10 in the chip-type coil component and a metal can covering an electronic component set may be prevented.

Therefore, as the external electrodes formed on the top surface of the body 10 are removed, defects such as interference or the like may not occur, even in a case in which the electronic component set and the metal can surrounding the same come into contact with each other.

Further, since limitations, such as a necessity for the securing of space or the like, caused due to the external electrodes 40 being formed on the top surface of the body 10, may be solved, a characteristic effective area of the product may be increased.

In addition, with the removal of the external electrodes made of metal from the top surface of the body 10, manufacturing costs of the product may be reduced.

The external electrodes 40 may be further formed on the two surfaces of the body 10 in the width direction. That is, the external electrodes 40 may be formed on five surfaces, among six surfaces of the body 10.

The body 10, the conductive patterns 20, and the like are the same as those described as above.

Referring to FIG. 4, a chip-type coil component according to another embodiment of the present invention may include the body 10 formed by stacking a plurality of magnetic layers and including a bottom surface provided as a mounting surface, a top surface opposed thereto, two surfaces in the length direction thereof and two surfaces in the width direction thereof; the conductive patterns 20 formed on the magnetic layers 30 and connected to each other so as to have a coil structure; and the external electrodes 40 formed on the bottom surface and the two surfaces in the length direction. In this case, the height h2 of one external electrode 40 formed on one surface of the body 10 in the length direction may be greater than the height h1 from the bottom surface to the farthest conductive pattern 20 therefrom and may be less than the height h3 from the bottom surface of the body 10 to the top surface thereof, while a height h1' of the other external electrode 40 formed on the other surface of the body 10 in the length direction may be greater than a height h4 from the bottom surface of the body 10 to the closest conductive pattern 20 thereto and may be less than the height h3 from the bottom surface of the body 10 to the top surface thereof.

In this case, since the external electrodes 40 may be formed such that the height h1' is less than the height h2, a spacing distance between the metal can covering the electronic component set and the external electrodes 40 may further increase, and as a result, a possibility of generating defects, such as short-circuits may be reduced.

In addition, since the amount of a material consumed for the external electrodes 40 is reduced, manufacturing costs may be reduced.

The external electrode 40 may be further formed on the two surfaces of the body 10 in the width direction. That is, the external electrodes 40 may be formed on five surfaces, among six surfaces of the body 10.

The body 10, the conductive patterns 30, and the like are the same as those described as above.

As shown in FIG. 5, an insulating layer 60 may be formed on an area of external surfaces of the body 10, in which the external electrodes 40 are not formed.

The body 10 may be prevented from being contaminated due to external moisture, foreign substances, or the like by the insulating layer 60.

In a case in which moisture or the like permeates through a grain boundary of the body 10 and current is repeatedly applied thereto, insulating properties of the body 10 may be deteriorated due to a deterioration of the grain boundary, and as a result, a service life of the product may be shortened.

The insulating layer 60 may be formed through the coating of a material such as silicon, epoxy or the like, or through glass coating.

As shown in FIG. 6, the insulating layer 60 may be formed on the entirety of the surfaces of the body 10 and the external electrodes 40 may be formed on the insulating layer 60.

After the insulating layer 60 may be formed to surround the entirety of the surfaces of body 10 which has been sintered, the external electrodes 40 may be formed thereon. In this case, lead parts of the conductive patterns 20 may be electrically connected to the external electrodes 40.

Since the foreign substances permeating through the external electrodes 40 may be blocked, the body 10 may be protected more efficiently.

As set forth above, according to embodiments of the present invention, even in a case in which a chip-type coil component set contacts a metal can, interference such as short-circuits does not occur, and as a result, a chip-type coil component having excellent reliability can be acquired.

Further, since an occupancy space of the chip-type coil component is reduced, a size of an electronic product can be minimized.

In addition, in accordance with the removal of an upper external electrode, manufacturing costs can be reduced.

While the present invention has been shown and described in connection with the embodiments, it will be apparent to those skilled in the art that modifications and variations can be made without departing from the spirit and scope of the invention as defined by the appended claims.

What is claimed is:

1. A chip-type coil component comprising:

a body formed by stacking a plurality of magnetic layers and including a bottom surface provided as a mounting surface, a top surface opposed thereto, two surfaces in a length direction thereof and two surfaces in a width direction thereof;

conductive patterns formed on magnetic layers and connected to each other so as to have a coil structure; and external electrodes formed on the bottom surface and the two surfaces in the length direction;

wherein a height of the external electrodes in a thickness direction of the body is greater than a height from the bottom surface to a farthest conductive pattern therefrom among the conductive patterns and is less than a height from the bottom surface of the body to the top surface thereof, wherein an insulating layer is formed on the entirety of the surfaces of the body and the external electrodes are formed on the insulating layer.

2. The chip-type coil component of claim 1, wherein an insulating layer is formed on an area of the surfaces of the body, in which the external electrodes are not formed.

3. The chip-type coil component of claim 1, wherein the external electrodes are further formed on the two surfaces of the body in the width direction.

4. The chip-type coil component of claim 3, wherein an insulating layer is formed on an area of the surfaces of the body, in which the external electrodes are not formed.

5. The chip-type coil component of claim 3, wherein an insulating layer is formed on the entirety of the surfaces of the body and the external electrodes are formed on the insulating layer.

6. A chip-type coil component comprising:

a body formed by stacking a plurality of magnetic layers and including a bottom surface provided as a mounting surface, a top surface opposed thereto, two surfaces in a length direction thereof and two surfaces in a width direction thereof;

conductive patterns formed on magnetic layers and connected to each other so as to have a coil structure; and external electrodes formed on the bottom surface and the two surfaces of the body in the length direction;

wherein a height of one external electrode formed on one surface of the body in the length direction is greater than a height from the bottom surface to a farthest conductive pattern therefrom among the conductive patterns and is less than a height from the bottom surface of the body to the top surface thereof, while a height of the other external electrode formed on the other surface of the body in the length direction is greater than a height from the bottom surface of the body to a closest conductive pattern thereto among the conductive patterns and is less than the height from the bottom surface of the body to the top surface thereof.

7. The chip-type coil component of claim 6, wherein an insulating layer is formed on an area of the surfaces of the body, in which the external electrodes are not formed.

8. The chip-type coil component of claim 6, wherein an insulating layer is formed on the entirety of the surfaces of the body and the external electrodes are formed on the insulating layer.

9. The chip-type coil component of claim 6, wherein the external electrodes are further formed on the two surfaces of the body in the width direction.

10. The chip-type coil component of claim 9, wherein an insulating layer is formed on an area of the surfaces of the body, in which the external electrodes are not formed.

11. The chip-type coil component of claim 9, wherein an insulating layer is formed on the entirety of the surfaces of the body and the external electrodes are formed on the insulating layer.

* * * * *